United States Patent [19]

den Hartog

[11] Patent Number: 4,871,436

[45] Date of Patent: Oct. 3, 1989

[54] SUSPENSION BAR FOR ANODE AND/OR CATHODE SHEETS IN THE ELECTROLYTIC REFINING OF METALS AND A METHOD FOR THE MANUFACTURE OF SUCH A SUSPENSION BAR

[76] Inventor: Gerardus H. J. den Hartog, F.A. Molijnlaan 78, 8071 AH Nunspeet, Netherlands

[21] Appl. No.: 162,557

[22] Filed: Mar. 1, 1988

[30] Foreign Application Priority Data

Mar. 5, 1987 [NL] Netherlands ..... 8700537

[51] Int. Cl.[4] ..... C25B 9/02; C25C 7/02

[52] U.S. Cl. ..... 204/286; 204/297 R

[58] Field of Search ..... 204/297 R, 297 W, 286, 204/279; 428/676, 677

[56] References Cited

U.S. PATENT DOCUMENTS

| | | | |
|---|---|---|---|
| 825,591 | 7/1906 | Engelhard | 204/297 W |
| 1,515,348 | 11/1924 | Levin | 204/286 |
| 1,803,017 | 4/1931 | Herschmann | 428/677 |
| 2,434,731 | 1/1948 | Zu Eltz | 204/286 |
| 2,723,230 | 11/1955 | Godsey | 204/286 |
| 3,276,985 | 10/1966 | Lancy | 204/297 W |
| 3,499,831 | 3/1970 | McMinn et al. | 428/676 |
| 3,515,661 | 6/1970 | Coulter et al. | 204/286 |
| 3,630,880 | 12/1971 | Howard | 204/297 R |
| 4,014,763 | 3/1977 | Lowe | 204/286 |
| 4,043,893 | 8/1977 | Gelfand | 204/286 |
| 4,186,074 | 1/1980 | Perry | 204/286 |
| 4,373,654 | 2/1983 | Prengaman | 204/286 |
| 4,606,804 | 8/1986 | Schulke et al. | 204/286 |
| 4,619,752 | 10/1986 | Koziol et al. | 204/286 |
| 4,647,358 | 3/1987 | Bartsch et al. | 204/286 |

FOREIGN PATENT DOCUMENTS

| | | | |
|---|---|---|---|
| 0175395 | 5/1985 | European Pat. Off. . | |
| 1422260 | 11/1964 | France | 204/286 |
| 963708 | 7/1964 | United Kingdom | 204/297 W |
| 1000859 | 11/1965 | United Kingdom | 204/297 R |
| 2001347A | 1/1979 | United Kingdom | 204/286 |
| 2041002A | 9/1980 | United Kingdom . | |

OTHER PUBLICATIONS

Bowry, E. I., "A New Concept in Plating Jig Design", Products Finishing, vol. 30, No. 8, pp. 24, 25, Sep. 1977.

*Primary Examiner*—John J. Zimmerman
*Attorney, Agent, or Firm*—Ralph M. Burton

[57] ABSTRACT

Suspension bar for an anode or cathode sheet in electrolytic refining of metals, the core of the suspension bar consisting of a material which exhibits a high resistance to bending and a high mechanical resistance, and being surrounded by a sheath of a material with good electrical conducting properties, such as copper. The core material is a material with good electrical conduction properties, such as copper, near at least one of the ends of the suspension bar, preferably near both ends, over a length of a least 3 cm and at most 5 cm, the sheath being continuous to the end of said core part.

Method for manufacturing such a suspension bar in which a sheath of copper is drawn over a core of steel, starting from copper tube. Copper and steel cores are alternately introduced into the copper tube, subsequently the sheath is drawn, with further cores being added, to a total length which essentially corresponds to the change in length of the copper tube occurring as a result of the drawing and, finally, the rod produced is sawn up into the desired rod lengths at the points where the copper cores are located.

2 Claims, 1 Drawing Sheet

SUSPENSION BAR FOR ANODE AND/OR CATHODE SHEETS IN THE ELECTROLYTIC REFINING OF METALS AND A METHOD FOR THE MANUFACTURE OF SUCH A SUSPENSION BAR

BACKGROUND OF THE INVENTION

The invention relates to a suspension bar for an anode or cathode sheet.

In the electrolysis process, the purity of metals is increased by means of anodes, cathodes, an electrolyte and electrical power The cathodes consist of a thin sheet of the same metal as the one which has to be purified In some cases, the anodes are insoluble sheets, but generally the anodes are manufactured from the metal to be purified As the result of the passage of current, the last named anodes will go into solution, while the metal ions of the metal to be purified will deposit at the cathode as a result of which the cathode sheets will start to grow. The cathode or anode sheets may be rather heavy. The sheets are suspended on suspension bars which also serve as current conductors. The suspension bars should therefore have good mechanical properties especially in relation to the bending load.

Because the suspension bars also serve as current conductors and, for economic reasons, the electrolysis takes place with a high amperage and a low voltage, the suspension bars should preferably be manufactured from copper in order to keep the current losses as low as possible. For this purpose, hard copper is used; the tensile strength of copper is increased by plastic deformation. If such hard copper is heated, the tensile strength will fall off considerably. The tensile strength of copper is lowest in the soft state.

If the current strength is increased in the electrolysis process, copper suspension bars may pass into the soft state as a consequence of the development of heat, as a result of which they may easily deform owing to excessive loading during electrolysis or rough handling when the sheets are being replaced, as a result of which the electrolysis process can no longer proceed ideally on further use or it may not even be at all possible to use said suspension bars any longer.

DESCRIPTION OF THE PRIOR ART

The assignee of the present patent application has manufactured and marketed suspension bars, for the abovementioned purpose, the core of which consisted of a material which exhibits a high resistance to bending and a high mechanical resistance, for example an iron alloy, such as steel. The core was surrounded by a sheath of a material with good electrical conducting properties, such as copper. This prior art suspension bar has not been described in any patent publication.

OBJECTS OF THE INVENTION

One object of the invention is to provide a suspension bar which exhibits good mechanical properties and has an improved current passage and low current losses, so that it can take high current values.

Another object in to provide a method for the manufacture of such an improved suspension bar.

SUMMARY OF THE INTENTION

According to the invention, near at least one of the ends of the suspension bar, over a length of at least 3 cm and at most 5 cm, the core material is a material with good electrical conduction properties, such as copper, the sheath being continuous to the end of said core part.

Preferably, both ends of the suspension bar are provided with a core part of material with good electrical properties.

From tests it emerges that suspension bars with steel core, the ends of which, however, are completely of copper over a number of centimeters, are almost as good, as regards the mechanical properties, as the suspension bars, the core of which is provided virtually over the whole length with a steel core. It hardly ever happens that the ends deform even though they are manufactured from soft copper since even if a suspension bar drops, the torque is always low as a result of the short arm. On the other hand, the electrical properties are considerably improved. A better heat discharge also appears to take place near the point where the suspension bars are supported on the current conductors The latter is also the point of the greatest electrical resistance and, consequently, the point with maximum heat development.

The method for manufacture the suspension bar of the invention comprises the following steps:

introduction alternately copper and steel core pieces of appropriate lengths into a copper tube having a length which is a multiple of the length of one suspension bar in its final state, and said core pieces lying one against the other, drawing the tube over said core pieces to form the sheath, with further cores being added to a total length which essentially corresponds to the change in length of the copper tube occurring as a result of the drawing and sawing up the rod produced into the desired rod lengths at the points where the copper cores are located.

DISCUSSION OF FURTHER PRIOR ART

From GB-A No. 2,041,002 suspension bars with steel core are known which are provided at some distance from the ends with an inserted copper block at the point which is intended to be supported on the current supply rail. The manufacture thereof is fairly labour-intensive because the space for the block has to be milled out, while, after the copper block has been introduced, a welded joint has to be made over the entire circumference thereof with respect to the copper sheath of the rest of the bar. As a result of this weld, the risk of "leaks" is increased. i.e. the possibility that electrolyte liquid penetrates through the copper sheath and corrodes the steel core, which risk is also already present in any case because, as in all the known suspension bars provided with a steel armouring, a copper cover is welded on at the ends in order to seal off the steel core. bar, the solid copper block is of L-shaped construction so that it is continuous at the end of the bar and the separate provision of a cover is avoided However, in that case there is a very large seam to be welded at the boundary between said L-shaped copper block and the copper sheath, with the abovementioned drawbacks.

None of these drawbacks still apply in the construction or the method according to the invention. After all, if the end of the suspension bar contains a solid copper core piece and if the copper sheath not only extends over a steel core but is drawn over said copper core piece at the end, an absolutely tight seal between the sheath and said copper core piece is produced as a consequence of the drawing operation. There is consequently no danger at all of electrolyte liquid leaking into the interior. This therefore forms the most important consideration after the preferred embodiment of the bar according to the invention, in which the solid copper core piece is not only provided at the end of the rod which is intended to be supported on the current supply rail, but both ends are to be constructed in the same manner. In addition, as a result of this, the fabrication is obviously simpler than if one end were provided with a solid copper core piece and the other end not provided.

In any case, it will also be clear that the method according to the invention is simpler than that in which a piece has to be sawn out, a block has to be inserted and finally, a welded joint has to be made.

BRIEF DESCRIPTION OF THE DRAWINGS

The invention will be explained in more detail by reference to the drawing. In the drawing.

DESCRIPTION OF THE PREFERRED EMBODIMENT

Figure 1:
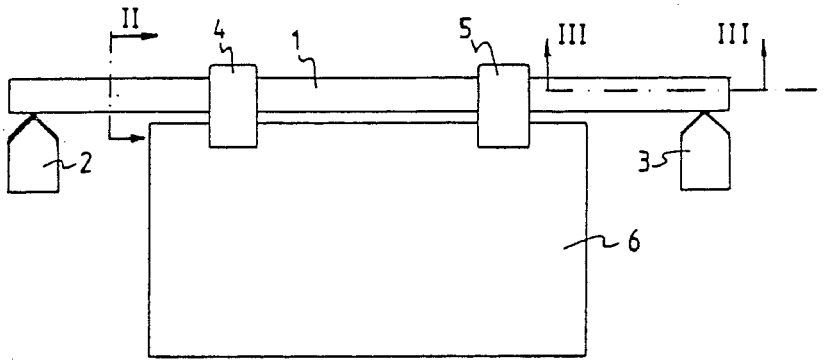
FIG. 1 diagrammatically shows a suspension bar supported by current conductors.

FIG. 1 shows a suspension bar 1 which is supported at either end by rods 2, 3, of which at least one, and to be precise, item 2, also serves as current conductor. A sheet 6 (an anode or cathode sheet) is suspended on the suspension rod 1 by means of hooks 4, the sheet 6 being suspended in the electrolyte.

Figure 2:
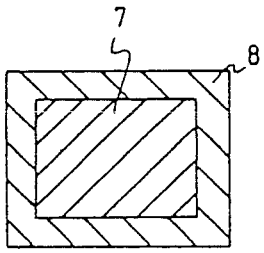
FIG. 2 shows a cross-section along the line II—II in FIG. 1.

FIG. 2 shows a cross-section through the suspension bar in FIG. 1; in this case the rod is rectangular in section and is constructed of a core 7 with a sheath 8 around it.

Figure 3:
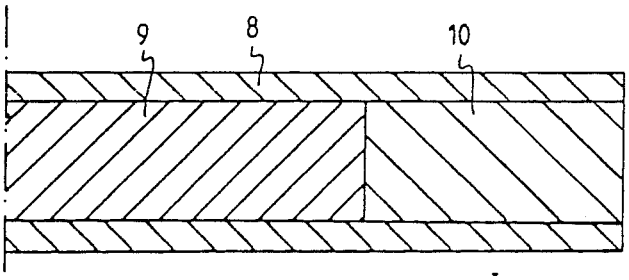
FIG. 3 shows a longitudinal section of the suspension bar in FIG. 1 along the line III—III.

FIG. 3 shows a longitudinal section through an end portion of the suspension bar along the line III—III in FIG. 1. In the copper outer sheath 8, the centre portion of the rod is filled up with a steel core 9 and, near the end, with a copper core 10.

During the electrolysis, many anode and cathode sheets are suspended alternately next to each other. The distances between the sheets should be identical everywhere, since otherwise the current passage through the electrolyte will not proceed correctly. If an anode or cathode sheet is suspended on the suspension bar, the suspension bar should have the correct shape; if the suspension bar is deformed as a result, for example, of the rod being dropped during transportation, the sheet will not assume the correct position in the electrolytic bath. As a result of providing the steel core, however, the suspension bar will not easily deform as a result of external forces.

If the suspension bar is provided over the entire length with a steel core, the current passage near the supporting rod 2, which serves as current conductor, will not be ideal. As a result of the high electrical resistance, considerable heat will also be produced at that point and it will be difficult to remove as a result of the poor conduction properties of steel. As a result of providing the end of the suspension bar with a copper core piece at the point where the electric current enters the suspension bar, not only will the electrical resistance be reduced but the discharge of heat is also improved. As a result of this, the possibility is prevented that the metal becomes so hot near the contact point of the suspension bar 1 with the supporting rod 2 that the mechanical properties of the materials near the point of contact will fall off.

Because the suspension bar is provided with a copper core only over a short distance at the end, hardly any deformation will occur if such a suspension bar falls, since as a result of the short length of the copper part, it will only be possible for the torque acting thereon to be small.

The manufacture of the suspension bars according to the invention is based on the method for manufacturing the prior art suspension bars, in which starting from copper tube, a sheath of copper is drawn in situ over a core of steel, both having a length which is a multiple of the length of one suspension bar in its final state. According to the invention, the procedure is therefore such that copper and steel cores of appropriate lengths are alternately introduced into the copper tube, subsequently the sheath is drawn in situ over the introduced core pieces, with further cores being added to a total length which essentially corresponds to the change in length of the copper tube occurring as a result of the drawing and finally, the rod produced is sawn up into the desired rod lengths at the points where the copper cores are located. The appropriate length for the steel parts is, as a matter of course, equal to the length of the steel core part in the ready-made bar. Appropriate length for the copper parts is double the desired length of the copper core part at each end of the ready-made bar, such as between 6 and 10 cm. When sawing through the middle, copper core parts of the proper length are produced on either end. The first and last copper parts introduced into each steel tube will be of the same length as those introduced in between the steel parts, and after drawing the extreme end pieces will be removed.

This method produces in a simple manner the suspension bar of the desired length, the centre section being provided with a steel core and the end with a copper core over the desired length.

What is claimed is:

1. In a suspension bar for an anode or cathode sheet in the electrolytic refining of metals, having an elongated core for the bar consisting of a first portion and a second portion arranged in end-to-end abutting relation with the first portion extending throughout the major length of the core and exhibiting a high resistance to bending and high mechanical resistance and the second portion arranged at least at one end of the first portion and exhibiting improved electrical conduction properties but inferior resistance to bending and mechanical resistance compared with the first portion, the invention characterized by:

a tube having electrical-conducting properties similar to said second portion and drawn in situ over both said first and second portions and extending from end to end thereof to form a continuous electrolyte-impervious sheath around the core throughout the length of the core, and said second portion extending within such sheath over a length of at least 3 cm. and not more than about 5 cm.

2. The invention defined by claim 1 wherein one such second portion is disposed at each end of said first portion and said tube is drawn in situ over the first portion and both second portions.

* * * * *